US011167822B2

(12) United States Patent
Michaeli et al.

(10) Patent No.: US 11,167,822 B2
(45) Date of Patent: Nov. 9, 2021

(54) INTEGRATED THRUSTER AND BALLAST SYSTEM

(71) Applicant: Ockerman Automation Consulting, Inc., Anacortes, WA (US)

(72) Inventors: Jennifer Michaeli, Smithfield, VA (US); Robert Walling, Pine Beach, NJ (US); Alden Nelson, Norfolk, VA (US)

(73) Assignee: Ockerman Automation Consulting, Inc., Anacortes, WA (US)

( * ) Notice: Subject to any disclaimer, the term of this patent is extended or adjusted under 35 U.S.C. 154(b) by 0 days.

(21) Appl. No.: 16/803,827

(22) Filed: Feb. 27, 2020

(65) Prior Publication Data

US 2021/0269123 A1 Sep. 2, 2021

(51) Int. Cl.

| | |
|---|---|
| ***B63B 13/02*** | (2006.01) |
| ***B63H 11/08*** | (2006.01) |
| ***B63H 11/10*** | (2006.01) |
| ***B63H 11/107*** | (2006.01) |
| *B63H 11/00* | (2006.01) |

(52) U.S. Cl.

CPC ..... *B63B 13/02* (2013.01); *B63H 11/08* (2013.01); *B63H 11/107* (2013.01); *B63H 2011/008* (2013.01); *B63H 2011/081* (2013.01)

(58) Field of Classification Search

CPC ..... B63B 13/00; B63B 13/02; B63H 11/00; B63H 11/08; B63H 11/10; B63H 11/107; B63H 25/00; B63H 25/46; B63H 2011/008; B63H 2011/081

USPC ..... 114/151, 184

See application file for complete search history.

(56) References Cited

U.S. PATENT DOCUMENTS

| | | | | |
|---|---|---|---|---|
| 3,933,113 | A * | 1/1976 | Dornak, Jr. | B63H 25/46 114/151 |
| 6,009,822 | A * | 1/2000 | Aron | B63H 25/46 114/151 |
| 6,932,013 | B1 | 8/2005 | Shen et al. | |
| 8,297,213 | B2 | 10/2012 | Liberg | |
| 2009/0101056 | A1 * | 4/2009 | Waldo | B63H 25/46 114/151 |
| 2017/0137101 | A1 | 5/2017 | Ayotte et al. | |
| 2018/0072390 | A1 | 3/2018 | Hartman | |

OTHER PUBLICATIONS

International Search Report and Written Opinion for PCT Application No. PCT/US2021/020064, dated May 20, 2021.

* cited by examiner

*Primary Examiner* — Lars A Olson
(74) *Attorney, Agent, or Firm* — Dorsey & Whitney LLP

(57) ABSTRACT

An integrated thruster and ballast system in accordance with some examples herein may include a conduit disposed within a hull of the boat. The conduit includes a first opening in fluid communication with a body of water, a second opening in selective fluid communication with the body of water, and an outlet disposed within the boat. The integrated thruster and ballast system includes a ballast tank in selective fluid communication with the conduit via the outlet, a thruster disposed within the conduit and configured to move water through the conduit, a first valve disposed in the conduit and configured to selectively divide or establish the fluid communication between the conduit and the ballast tank; and a second valve disposed in the conduit and configured to selectively divide or establish the fluid communication between the second opening and the body of water.

23 Claims, 4 Drawing Sheets

INTEGRATED THRUSTER AND BALLAST SYSTEM

FIELD

The present disclosure relates generally to watercraft, and more specifically to integrated thruster and ballast systems for a boat.

BACKGROUND

Boats, such as surface vessels, submarines, semisubmersibles or other watercraft may be equipped with thrusters to increase maneuverability or provide propulsion at low or maneuvering speeds. Lateral thrusters that provide thrust athwartships in a starboard or port direction may be beneficial in docking, beaching, dynamic positioning or other operations where it is desired to move a boat, or a portion of a boat, laterally and/or rotate a boat about its vertical axis. Propulsion thrusters that provide thrust in a bow or stern direction may be beneficial to transit or maneuver a boat at low speeds.

Boats may include the ability to carry additional weight or ballast to modify stability characteristics or reduce resistance and improve beaching capability through changing trim. Ballast can be added or removed as desired based on cargo, sea conditions, speed and other factors. Typically, water is used as a ballast and is stored in ballast tanks which are filled or emptied of water as desired. A typical use of ballast is to provide increased righting moment to the boat by lowering vertical center of gravity ("VCG"), in which case the ballast may be stored in tanks below the current VCG of the boat.

In current boats, ballast tanks are filled and drained with dedicated ballast pumps. Thrusters are likewise dedicated propellers, propulsors, or waterjets that provide thrust at various locations. These separate, dedicated systems add cost, complexity, and reduced reliability due to the presence of additional parts to a boat. In addition, separate systems require separate packaging volume, piping, electronics, controls and prime movers to power them. Therefore, solutions are needed that can provide thruster and ballast capability to a boat in a single, integrated system.

SUMMARY

An integrated thruster and ballast system for a boat is provided. The integrated thruster and ballast system includes a conduit disposed within a hull of the boat. The conduit includes a first opening in fluid communication with a body of water, a second opening in selective fluid communication with the body of water, and an outlet disposed within the boat. A ballast tank is in selective fluid communication with the conduit via the outlet. A thruster is disposed within the conduit and configured to move water through the conduit. A first valve is disposed in the conduit and configured to selectively divide or establish the fluid communication between the conduit and the ballast tank, and a second valve is disposed in the conduit and configured to selectively divide or establish the fluid communication between the second opening and the body of water.

In some embodiments, when the first valve is in an open position, the fluid communication between the conduit and the ballast tank is established, and when the second valve is in a closed position, the fluid communication between the body of water and the second opening is divided. In some embodiments, the thruster is configured to fill or empty the ballast tank with ballast water. In some embodiments, when the first valve is in a closed position, the fluid communication between the conduit and the ballast tank is divided, and when the second valve is in an open position, the fluid communication between the body of water and the second opening is established. In some embodiments, the thruster is configured to provide a thrust to the boat athwartships to push the boat in a port direction or a starboard direction. In some embodiments, the thruster is provides propulsive thrust to the boat to push the boat fore or aft. In some embodiments, the thruster is reversible.

In some embodiments, a second conduit is disposed within the hull of the boat. The second conduit includes a third opening in fluid communication with the body of water and a fourth opening in selective fluid communication with the body of water. A second outlet is disposed within the boat and a second ballast tank is in selective fluid communication with the second conduit via the second outlet. A second thruster is disposed within the second conduit and configured to move water through the second conduit. A third valve is disposed in the second conduit and configured to selectively divide or establish the fluid communication between the second conduit and the second ballast tank. A fourth valve is disposed in the second conduit and configured to selectively divide or establish the fluid communication between the fourth opening and the body of water. In some embodiments, one of the second opening or the fourth opening is disposed on a starboard side of the boat, and the other of the second opening or the fourth opening is disposed on the port side of the boat. In some embodiments, one of the ballast tank or the second ballast tank is disposed fore of the other of the ballast tank or the second ballast tank. In some embodiments, as one of the first valve or second valve transitions between an open and closed position, a flow of the thruster is reduced. In some embodiments, one of the thruster or the second thruster generates a thrust in a starboard direction and the other of the thruster or the second thruster generates a thrust in a port direction. In some embodiments, the thrust in the starboard direction and the thrust in the port direction are generated simultaneously and the thrusts generate a rotational couple on the boat. In some embodiments, the thruster is configured to dewater a compartment in the boat in a damage control situation.

BRIEF DESCRIPTION OF THE DRAWINGS

The description will be more fully understood with reference to the following figures in which components may not be drawn to scale, which are presented as various examples of the integrated thruster and ballast system described herein and should not be construed as a complete depiction of the scope thereof.

DETAILED DESCRIPTION

The integrated thruster and ballast systems disclosed herein can provide thrust to a boat in one configuration and ballasting (filling or draining ballast tanks) to the boat in a second configuration. In some configurations an integrated thruster and ballast system can provide thrust and ballast adjustment simultaneously. In some embodiments, the system is configured to provide thrust for maneuvering or heading adjustments. Such embodiments of the integrated thruster and ballast system may be referred to as integrated maneuvering thruster and ballast systems. In other embodiments, the integrated thruster and ballast systems may be configured to provide propulsive thrust (e.g., thrust directed in the travel direction or opposite the travel direction) and such embodiments may thus be referred to as an integrated propulsive thruster and ballast systems.

Figure 1:
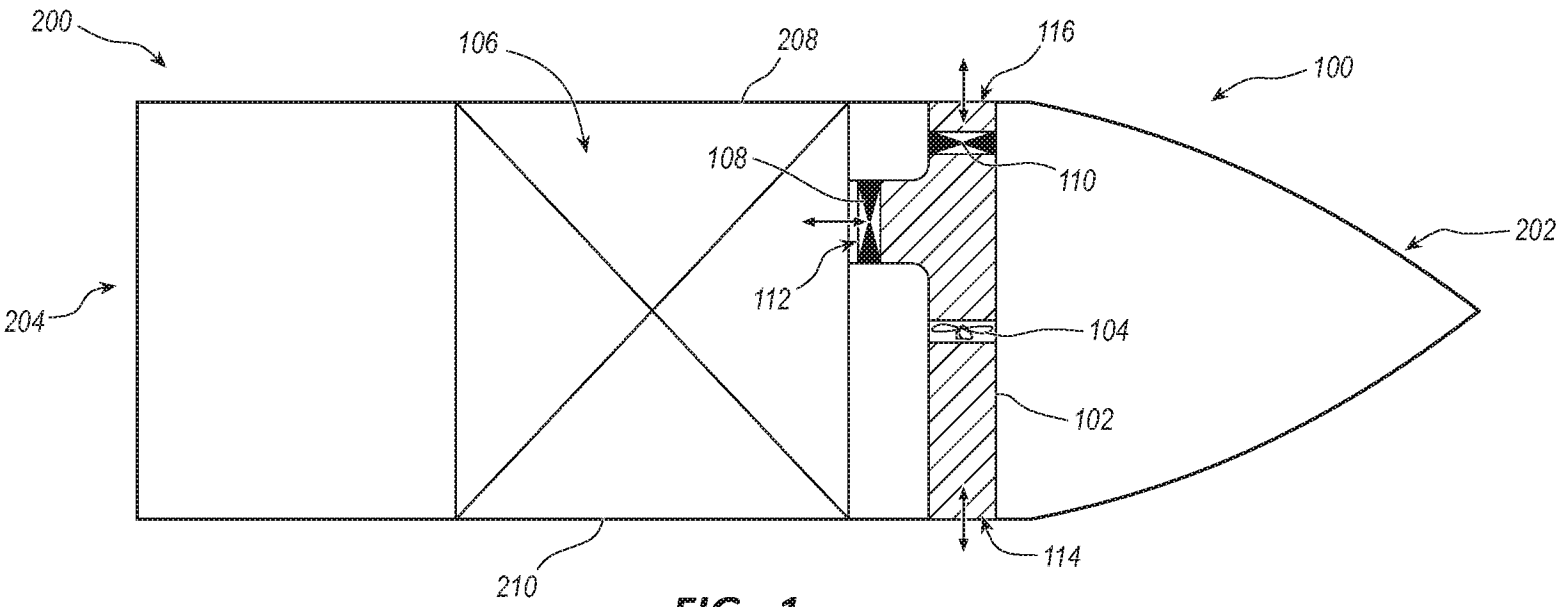
FIG. 1 is a plan schematic view of an integrated lateral thruster and ballast system.
Figure 2:
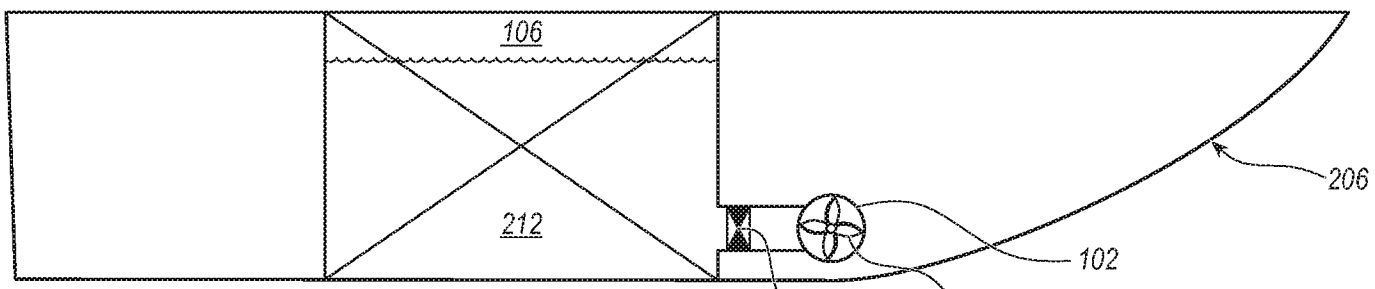
FIG. 2 is a longitudinal section view of the integrated lateral thruster and ballast system of FIG. 1 viewed from the starboard side of the boat.

FIGS. 1 and 2 illustrate an embodiment of an integrated thruster and ballast system 100 configured as an integrated maneuvering thruster and ballast system. As used herein, a thruster refers to any device, apparatus, or system that causes a change in momentum of water in order to impart a thrust on a boat 100. Examples of a thruster include a propeller, impeller, pump, thruster, propulsor, or waterjet. The system 100 includes a transverse or lateral conduit 102, a thruster 104, a ballast tank 106, a ballast tank isolation valve 108, and a conduit isolation valve 110. The integrated thruster and ballast system is shown in relation to a boat 200 with a bow 202 and a stern 204. The integrated thruster and ballast system 100 in this embodiment is located near the bow 202 of the boat 200, and thus selectively functions, in this example, as a bow thruster. In other embodiments, a thruster 104 and the associated conduit 102 can be located in any suitable location from the bow 202 of the boat 200 to the stern 204, and provide thrust athwartships to the boat at that location. Providing such thrust may be useful for maneuvering, station keeping, or dynamic positioning purposes. While described as transverse, it will be understood that the conduit and thus the direction of transverse thrust provided in this configuration need not be perfectly perpendicular to the longitudinal axis of the boat, but may be angled thereto. As such, transverse (or maneuverability) thruster, in the context of this application, implies that the thruster is not aligned longitudinally and is thus not used for forward or reverse propulsion but is instead used for adjustments to the yaw and sway of the vessel.

Referring to FIGS. 1 and 2, the conduit 102 is shown as a substantially hollow passageway extending through the hull 206 of the boat 200 athwartships between the port side 208 and starboard side 210. For simplicity, the conduit 102 is illustrated as a generally straight passageway, however conduit may have bends or curves in any of its portions between the first, second, and third openings 112, 114, and 116. As illustrated in FIGS. 1 and 2, the conduit 102 is used to connect the ballast tank 106 to the exterior of the hull 206 so as to fluidly couple the ballast tank 106 to the body of water surrounding the hull 206 of the boat 200. The ballast tank 106 is fluidly connected to the conduit 102 via a first opening 112. When filling the ballast tank 106, the first opening 112 may be used to deliver water from the conduit 102 into the ballast tank 106. When emptying the ballast tank 106, the first opening 112 may be used to evacuate water from the ballast tank 106 into the conduit 102 and then to the body of water surrounding the hull 206. Thus, the first opening 112 may also be referred to herein as an outlet opening or simply outlet 112.

The conduit 102 may further include a pair of transverse openings (e.g., second and third openings 114 and 116, respectively) in opposite sides of the hull 206 of the boat. For example, as shown in FIG. 1, the conduit 102 has a second opening 114 located at the starboard side 210 of the boat, and a third opening 116 located at the port side 208 of the boat. The openings 114, 116 are formed in the outer hull 206 of the boat so as to fluidly connect the passageway of conduit 102 to the body of water in which the boat floats. Water can flow into or out of the conduit 102 through either side. When water is propelled out of one of the transverse openings (e.g., the first opening 114 or the second opening 116), thrust on the boat 200 is generated in the opposite direction of the water flowing out of a transverse opening. That thrust tends to push the boat in the direction of the thrust, and this transverse thrust is referred to as maneuvering thrust. For example, if water flows out of the port 208 side opening 116 of the conduit 102, a thrust is generated on the boat 200 in the starboard direction. Likewise, if water flows out of the starboard side 210 opening 114 of the conduit 102, a thrust is generated on the boat 200 in the port direction. The interior or passageway of the conduit 102 is generally sealed in a watertight fashion from other portions of the interior of the boat (e.g., dry areas of the internal cavity defined by the hull 206), to prevent water from entering these dry areas. As shown in FIGS. 1 and 2, the conduit 102 of the transverse thruster of the present disclosure has another opening (outlet 112) that fluidly connects the conduit 102 to a ballast tank 106.

The system 100 may include a thruster 104, in some cases a reversible thruster, configured to force water to move into and out of the conduit 102 thereby selectively generating water flow out either one of the two openings 114 and 116 for generating transverse (or maneuvering) thrust. The thruster 104 may thus be interchangeably referred to as a bow thruster 104 and when positioned near the bow 202, or a stern thruster when located near the stern 204. In the illustrated example, the thruster 104 is situated generally axially within the conduit 102. In this embodiment, the thruster 104 is reversible, such that it can push water out of either the port side 208 opening 116 or the starboard side 210 opening 114 of the conduit 102, drawing water in to the other one of the port side 208 opening 116 or the starboard side 210 opening 114. In some embodiments, the thruster 104 may be operable in only one direction. In some such embodiments, a pair of thrusters that push water in opposite directions may be used. In the embodiment shown in FIGS. 1 and 2, the thruster 104 is a thruster driven by a motor or other prime mover. In one configuration the thruster spins axially in one direction to move water in a corresponding direction through the conduit 102. For example, when viewed from the starboard side 210 of the boat 200 as in FIG. 2, the thruster may have blades pitched such that as the thruster spins clockwise, it pushes water toward the starboard side 210 of the boat 200. If the thruster spins counter-clockwise when viewed as in FIG. 2, it may push water toward the port side of the boat 200. In other embodiments, the above relationships between clockwise rotation and starboard side flow, and counter-clockwise rotation and port side flow may be reversed. In some embodiments, the thruster need not be axially positioned with respect to the conduit 102 but may be otherwise operatively arranged to create a water flow in a desired direction through the conduit 102.

The ballast tank 106 is configured to hold ballast water 212 such as to modify stability characteristics or reduce resistance and improve beaching capability through changing trim of the boat 200. In the embodiment in FIGS. 1 and 2, the ballast tank 106 is located amidships. However, in other embodiments, the ballast tank 106 may be located in other locations in the boat such as at the bow or stern of the vessel. The ballast tank 106 can be implemented as any substantially sealed cavity or container in or on the boat 200 capable of holding ballast such as water 212. In some embodiments, the ballast tank 106 may also be designed to hold fuel in a flexible bladder within the tank 106 the volume of which may be displaceable with water upon consumption of the fuel. In the schematic of FIG. 2, the ballast tank 106 is shown for simplicity as spanning substantially the full height of the boat's hull 206. However, it will be understood that the ballast tank 106 may have any other suitable shape or dimensions such as to define any regular or irregularly shaped volume within the hull of the vessel.

As illustrated, the conduit 102 of the transverse thruster 104 also connects the ballast tank 106 to the exterior (e.g., to the body of water surrounding the hull 206 in which the boat floats). The ballast tank 106 is in selective fluid communication with the conduit 102 via the first opening or outlet 112. To that end, the conduit 102 may be equipped with a first valve 108, referred to here as ballast tank isolation valve 108. The ballast tank 106 may be selectively fluidly connected or disconnected from the passageway of the conduit 102 by operation of the ballast tank isolation valve 108. The ballast tank isolation valve 108 may be implemented using any suitable two-way valve, such as a butterfly valve, that is controllable to an open state, in which the valve 108 permits passage of water between the ballast tank 106 and the conduit 102, and to a closed state, in which the ballast tank 106 is fluidly sealed from the conduit 102. In other words, when the valve 108 is open, ballast water 212 can flow between the ballast tank 106 and the conduit 102 and when the valve is closed, no ballast water can flow between the tank 106 and the conduit 102 as fluidic communication between the tank 106 and the conduit 102 is disabled.

The conduit 102 may be equipped with a second valve, referred to here as conduit isolation valve 110, which is operable to seal one of the inlet openings of the conduit 102 (e.g., the second opening 114 or the third opening 116) during filling or emptying of the ballast tank 106. In the embodiment of FIGS. 1 and 2, the conduit isolation valve 110 is shown near the port side 208 opening 116 of the conduit 102. In other embodiments, the conduit isolation valve 110 can be in other locations within the conduit 102. For example, the conduit isolation valve can be located near the starboard side 210 opening 114 of the conduit 102. The conduit isolation valve 110 may be implemented using any suitable valve, such as a butterfly valve, which is controllable to an open state to allow fluid flow through the valve, a closed state substantially preventing fluid flow through the valve or any intermediate state between the open and closed states for selectively adjusting the flow rate through the valve.

To operate the system 100 in thruster or maneuvering or dynamic positioning mode, the ballast tank isolation valve 108 may be closed and the conduit isolation valve 110 may be opened such that the selective operation of the thruster 104 (e.g., to push water in the starboard or port side direction) functions as a maneuvering thruster in this mode. To operate the system 100 in a ballasting mode, the conduit isolation valve 110 may be closed (partially or fully) and the ballast tank isolation valve 108 may be opened, such that water flow through the conduit 102 in a selected direction (i.e. into or out of the conduit 102) may be associated with filling or emptying the tank 106. That is, water being drawn into the conduit 102 from the exterior though the opening 114 may be used to fill the tank 106 or water being pushed out of the conduit 102 through opening 114 may be used to empty the tank 106. In some embodiments, the thruster 104, the ballast tank isolation valve 108, and the conduit isolation valve 110 may be operated in a coordinated or orchestrated fashion to selectively fill or drain the ballast tank 106, or to provide lateral thrust to the boat 200. For example, the opening or closing of the valves 108, 110 can be timed (e.g., to occur substantially concurrently) and/or the operation of one or both of the valves may additionally or alternatively be timed to coincide with activation of the thruster 104. In some embodiments, power to the thruster 104 may be turned off or reduced during the period of time when valves 108, 110 are transitioning between open and closed positions, for instance to reduce the effects of water hammer.

In a first configuration, the integrated thruster and ballast system 100 may be operated with the ballast tank isolation valve 108 open and the conduit isolation valve 110 is closed. In such configuration or operational mode, the thruster 104 takes water in on the starboard side 210 opening 114 of the conduit 102 and pushes it toward the port side 208 opening 116. Ballast water 212 flows from the conduit 102, through the conduit outlet 112 and into the ballast tank 106. The integrated thruster and ballast system may thus be operated in this configuration to add a desired amount of ballast water 212 to the ballast tank 106.

In a second configuration, the system 100 may be operated with the valves 108, 110 opened and closed, respectively, while the direction of the thruster 104 is reversed such that ballast water 212 is drawn from the ballast tank 106 through the conduit outlet 112, into the conduit 102 and discharged out the starboard side of the conduit, thus draining the ballast tank 106. In such a configuration or operational mode, thrust may be generated at the starboard side 210 of the boat 200, the thrust pushing the boat 200 in the port 208 direction. In other embodiments, the conduit isolation valve 110 can be positioned to selectively seal the conduit 102 from the starboard side of the boat 100, and thrust can be generated on the port side 208 of the boat 100, pushing the boat 100 in the starboard 210 direction. Thus, in such an operational mode, and depending on the rate at which water is being drained out of the ballast tank 106, the flow of water out of the conduit 102 may be used not only for de-ballasting but also for maneuvering. In some cases, the flow rate of water out of the conduit may be controlled to reduce the effect of transverse thrust on the boat, or alternatively or additionally another thruster may be used to compensate for any yawing or swaying effect on the boat.

In another configuration, the system 100 may be operated with the ballast tank isolation valve 108 closed and the conduit isolation valve 110 opened. In such configuration or operational mode, the thruster 104 can take water in on the port side 208 opening 116 of the conduit 102 and discharge the water to the starboard side 210 opening 114 thereby creating a thrust on the boat 200 in the port 208 direction.

In a fourth configuration, such as when the thruster 104 is implemented using a reversible thruster, the system 100 may be operated with the valves 108, 110 closed and opened, respectively, and the thruster 104 may be operated to take water in on the starboard side 210 opening 114 of the conduit 102 and discharge the water to the port side 208 opening 116 thereby creating a thrust in the starboard 210 direction.

Figure 3:
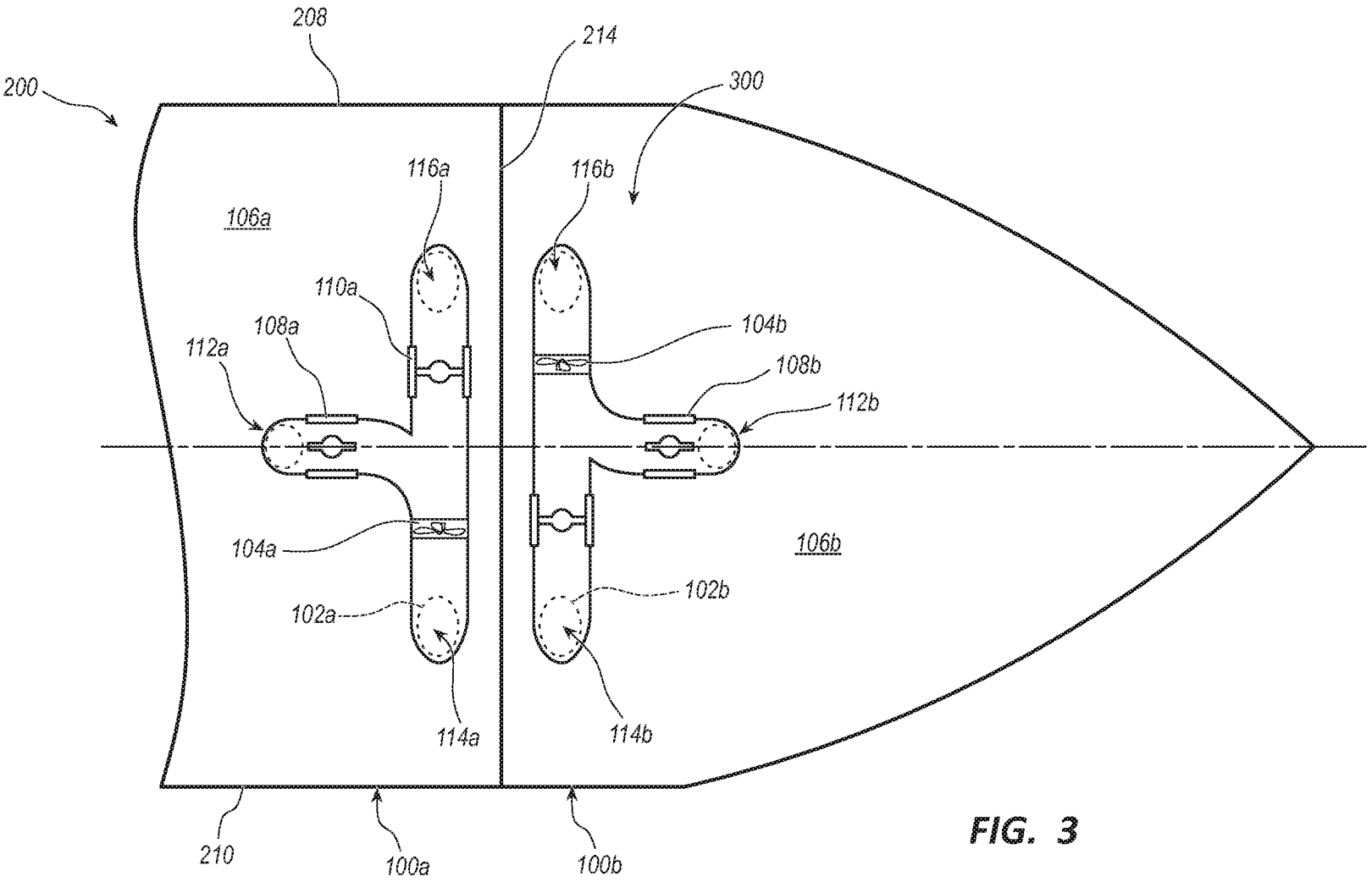
FIG. 3 is a plan schematic view of another embodiment of an integrated lateral thruster and ballast system including fore and aft portions.

FIG. 3 shows an integrated thruster and ballast system 300 according to further examples of the present disclosure. The integrated thruster and ballast system 300 includes a first (or aft) portion 100*a* and a second (or forward) portion 100*b*, each of which is configured and operates similarly to the integrated thruster and ballast system 100 described previously with reference to FIGS. 1 and 2. Each of the portions 100*a* and 100*b* of the integrated thruster and ballast system 300 includes a transverse or lateral conduit 102*a* or 102*b*, a thruster 104*a* or 104*b*, a ballast tank 106*a* or 106*b*, a ballast tank isolation valve 108*a* or 108*b*, and a conduit isolation valve 110*a* or 110*b*, respectively. The first portion 100*a* in this example is operatively associated with a aft ballast tank 106*a*, while the second portion 100*b* is operatively associated with a second ballast tank 106*b* located forward of the ballast tank 106*a* (e.g., a tank located amidships or at the stern of the vessel). As such the first integrated thruster and ballast system or portion 100*a* may be configured to fill or drain a first ballast tank 106*a* and also selectively provide transverse (or maneuvering) thrust at a first longitudinal location of the boat 200. The second integrated thruster and ballast system or portion 100*b* may be configured to fill or drain a second ballast tank 106*b* and also selectively provide transverse (or maneuvering) thrust at a second longitudinal location of the boat 200. As conceived by the inventors, it may be desirable, in some cases, to include two or more integrated thruster and ballast systems, shown here as the portions 100*a* and 100*b*, such as to reduce or negate the effects of asymmetry in the system and/or to account for differences between the port and starboard flow characteristics of the thrusters 104*a*, 104*b* directional efficiency differences between the systems, such as may be due to reductions or disruptions to flow through the conduits 102*a-b* caused by the presence of the conduit isolation valves 110*a-b*. The use of more than one integrated thruster and ballast system 100 may facilitate directing ballast water 212 to different parts of the boat to modify stability characteristics or reduce resistance and improve beaching capability through changing trim. Additionally, by using more than one integrated thruster and ballast system, smaller thrusters can be used in tandem to achieve a desired thrust which may reduce packaging volume, and add redundancy to maintain thruster and ballasting capability should a system become damaged or otherwise inoperative.

In the example illustrated in FIG. 3, the first and second ballast tanks 106*a*, 106*b*, respectively are located at different longitudinal locations and separated by a bulkhead 214. In other embodiments, the first and second ballast tanks 106*a* and 106*b*, respectively, that are served by the integrated thruster and ballast system 300 may be located in other locations such as they may be a starboard and a portside ballast tank, respectively. While describing one of the conduits that feeds or removes water from a given ballast tank, it will be understood that in some examples, ballast water 212 may be directed to or removed from a ballast tank (e.g., either one of the tanks 106*a* or 106*b*, or any of the other ballast tanks in the other embodiments described herein) by other valve(s), pipe(s) or conduit(s) as may be appropriate or desired. In some embodiments, the first and second ballast tanks 106*a* and 106*b* may be fluidly and selectively connected for selectively moving ballast water between the tanks.

Figure 4B:
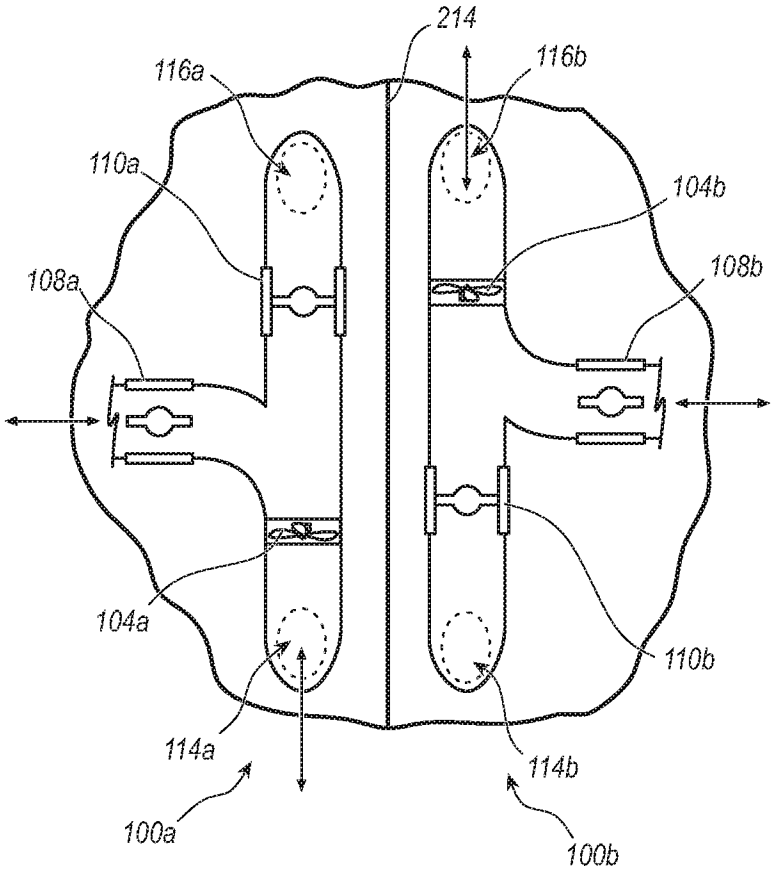
FIG. 4B is a schematic view of the integrated lateral thruster and ballast system of FIG. 3 in a second configuration.
Figure 4A:
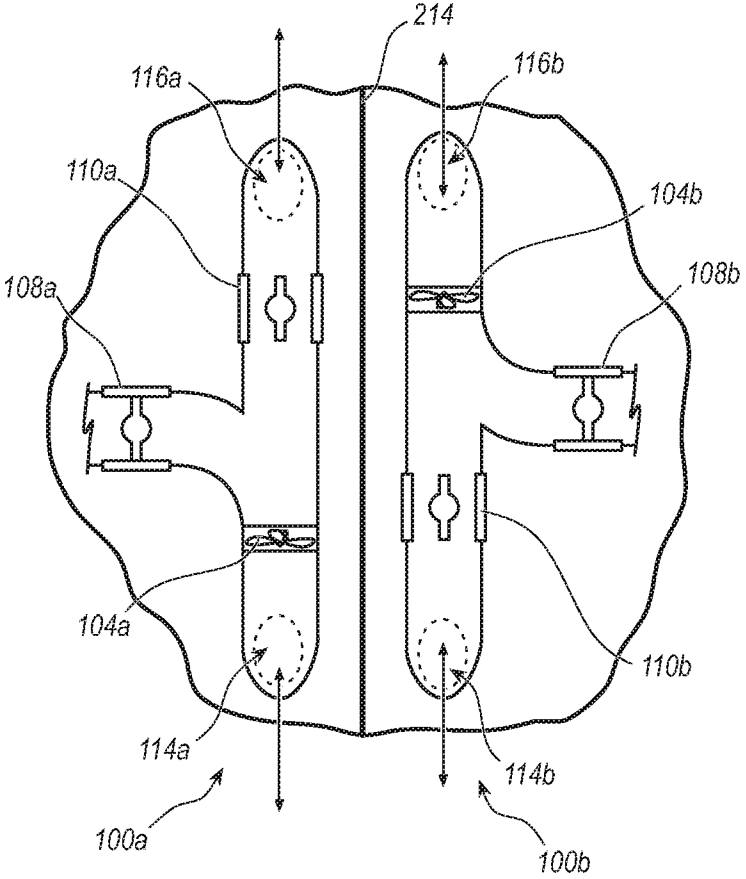
FIG. 4A is a schematic view of the integrated lateral thruster and ballast system of FIG. 3 in a first configuration.

As shown in FIGS. 3, 4A, and 4B, the integrated thruster and ballast system 300 includes a first portion 100*a* and a second portion 100*b*. The first portion 100*a* and the second portion 100*b* may be seen as being mirrored about two planes; one plane running longitudinally along the boat 100, and a second plane running athwartships. Thus, the conduit isolation valve 110*a* of portion 100*a* is located near, and selectively isolates the conduit 102*a* from, the port side 208, while the isolation valve 110*b* of portion 100*b* is near, and selectively isolates the conduit 102*b* from, the starboard side 210 of the boat 100. Such a configuration can combat asymmetry when operating the ballast system, resulting in consistent thrust on either the port or starboard sides of the boat 100. In certain embodiments, it may be advantageous to have a symmetric arrangement result in inconsistent thrust on either the port or starboard sides of the boat. Also, and because the portions 100*a* and 100*b* here are operatively associated with two ballast tanks that are forward and aft in relation to one another and the manifold (e.g., conduits, valves and thrusters) is locating generally between the two tanks, the section of conduit 102*a* connecting the portion 100*a* to the first (here aft) tank may be oriented generally toward the bow of the boat, while the section of conduit 102*b* connecting the portion 100*b* to the second tank may be oriented generally toward the bow of the boat. In another embodiment, one of the openings 114*b* and 116*b* of the forward portion 110*b* is longitudinally aft of the other hull opening 114*b* or 116*b*. Meanwhile, one of the openings 114*a* and 116*a* of the aft portion 110*a* is longitudinally forward of the other hull opening 114*a* or 116*a*. Such an embodiment creates a criss-crossing configuration of the openings 114*a/b*, 116*a/b* to cancel out or minimize and force couples caused by different fore/aft positions of the openings. In other embodiments, the openings 116*a* and 116*b* are positioned at the same fore/aft position and are located vertically one above the other. Likewise, the openings 114*a* and 114*b* are positioned at the same fore/aft position and are located vertically one above the other. In some embodiments, the openings 116*a* and 114*a* are transversely spaced from one another a transverse distance substantially the same as a transverse distance between openings 116*b* and 114*b*, as shown in FIG. 3. However, in other embodiments, the openings 116*a* and 114*a* can be spaced from one another a transverse distance substantially different from a transverse distance between openings 116*b* and 114*b*. Such embodiments may be used when sides of a boat at which the openings 114*a/b* and 116*a/b* are disposed are not parallel to one another, such as an integrated thruster and ballast system with openings in a V-shaped part of the hull of a boat 100.

In one configuration, as shown in FIG. 4A, the integrated thruster and ballast systems 100*a-b* are configured such that the conduit isolation valves 110*a-b* are open and the ballast tank isolation valves 108*a-b* are closed, such that the thrusters 104*a-b* can be operated to provide thrust to the boat 200. The thrusters 104*a-b* can be operated such that both generate thrust in the same direction, either to the port side 208 or the starboard side 210. Alternately, the thrusters 104*a-b* can be operated such that they generate thrust in opposite directions with respect to one another, thereby generating a force couple on the boat 200 that tends to rotate or pivot the boat 200 about an axis. In another embodiment, one or both of the thrusters 104*a-b* can generate respective thrusts athwartships, and the respective thrusts can rotate the boat about a vertical axis, inducing yaw.

In another configuration, as shown in FIG. 4A, the ballast tank isolation valves 108*a-b* are open and the conduit isolation valves 110*a-b* are closed. In this configuration, the thrusters 104*a-b* can fill or drain the respective ballast tanks 106*a-b*. One integrated thruster and ballast system can be configured to fill its ballast tank while another integrated thruster and ballast system is simultaneously configured to empty its ballast tank. For example, the integrated thruster and ballast system 100*a* can be configured to fill its ballast tank 106*a*, while the integrated thruster and ballast system 100*b* is configured to empty its ballast tank 106*b*. One integrated thruster and ballast system can be configured to provide lateral thrust, while another integrated thruster and ballast system is simultaneously configured to fill or drain its ballast tank. For example, the integrated thruster and ballast system 100*a* can be configured to provide thrust to the port 208 or starboard 210 side of the boat 200, while the integrated thruster and ballast system 100*b* is simultaneously configured to fill or drain its ballast tank 106*b*.

Figure 5:
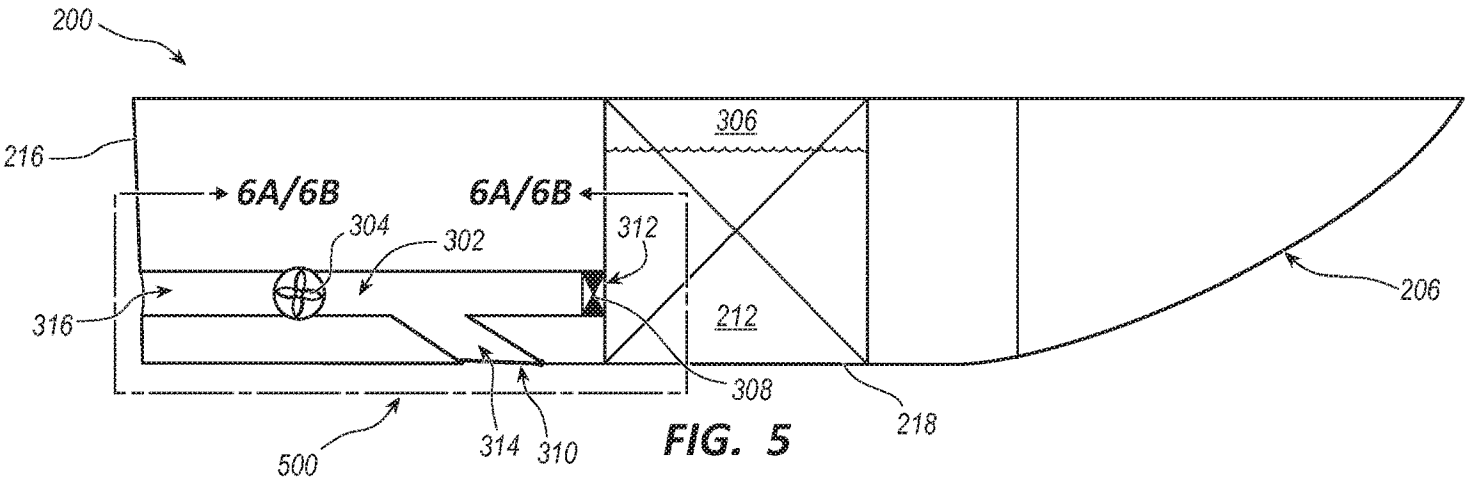
FIG. 5 is an elevation schematic view of an embodiment of a propulsion thruster and ballast system.
Figure 6B:
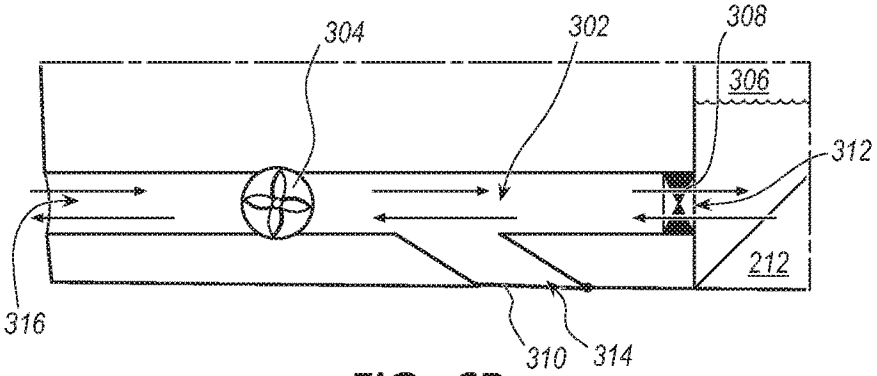
FIG. 6B is a schematic view of the propulsion thruster and ballast system of FIG. 5 in a second configuration.
Figure 6A:
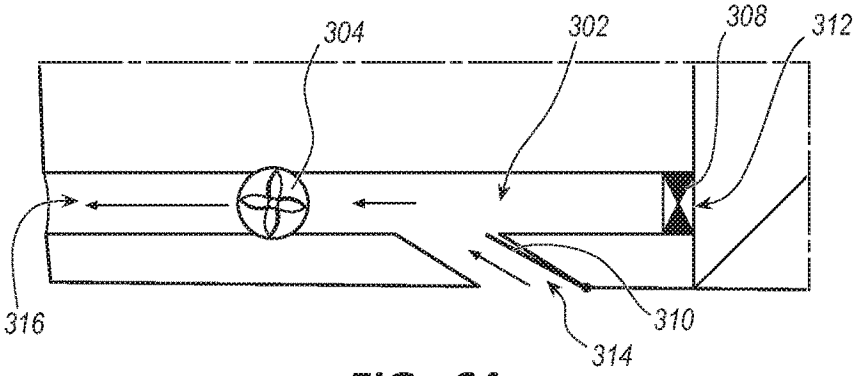
FIG. 6A is a schematic view of the propulsion thruster and ballast system of FIG. 5 in a first configuration.

Another embodiment of an integrated thruster and ballast system 500 is shown in FIGS. 5, 6A, and 6B. The integrated thruster and ballast system 500 includes a conduit 302, a thruster 304, a ballast tank 306, a ballast tank isolation valve 308, and a conduit isolation valve 310. In this embodiment, the integrated thruster and ballast system 300 is configured to provide propulsive thrust to the boat 200 (e.g., thrust directed generally in the longitudinal direction), while also selectively function to fill or drain one or more ballast tanks (e.g., tank 306). In some embodiments, the integrated thruster and ballast system 500 does not include a conduit isolation valve 310 or a keel opening 314.

In this embodiment, a portion of the conduit 302 extends longitudinally from a ballast tank 306 which may be located amidships or toward the stern of the boat 200. As such, the conduit 302 is configured to selectively fluidly connect the ballast tank 306 to the exterior of the hull and thus to the water in which the boat 302 floats. The conduit 302 has one opening 316, e.g., located at the stern of the boat 200 and thus also referred to as stern opening 316, and another opening 314, which may be located at the bottom of the hull such as near the keel and forward of the stern opening 316, and thus also referred to as keel opening 314. Although opening 314 may be referred to as a keel opening for clarity, the opening 314 can be located in other parts of the boat 100 than the keel. The openings 314 and 316 are formed in the outer hull of the boat such as to fluidly connect the interior passage of conduit 302 to the body of water in which the boat 200 floats. A thruster, such as a reversible thruster 304, may be operatively associated with the conduit 302 (e.g., axially arranged therein) to create water flow through the conduit 302, space and thus also be referred to as thruster 304. The conduit 302 may include a ramped inlet portion connecting the keel opening 314 to a location of the passageway of the conduit 302 between the thruster 304 and the outlet 312. A conduit isolation valve 310 may be provided at or near the keel opening 314 to selectively seal the keel opening 314. The conduit 302 may also be in selective fluid communication with the ballast tank 306 at the outlet 312 e.g., via the ballast tank isolation valve 308, which is located in the conduit 302 near or at the outlet 312. The valves 310 and 312 may be implemented using any suitable valve that can selectively divide or establish fluidic communication between the conduit 302 and the exterior of the boat or the ballast tank 306, respectively. Like other examples herein, the conduit 302 may be implemented using any suitable piping or structure that can constrain any water passing through the conduit from egressing into other portions of the boat such as dry areas of the hull.

In the embodiment shown in FIG. 5, the ballast tank 306 is shown located amidships or toward the stern of the boat 200. This embodiment is illustrative only and not limiting. In various embodiments, the ballast tank 306 can be in any suitable location within the boat. Additionally, the integrated thruster and ballast system 500 can include more than one ballast tank, and the tanks can be connected by piping, conduits, apertures or valves to allow ballast water 212 to be selectively added to different parts of the boat 200.

The thruster 304 is situated within the conduit 302. In this embodiment, the thruster 304 is reversible, as with other thrusters previously described.

In a first configuration, as show in FIG. 6A, the integrated thruster and ballast system 300 is configured to provide propulsive thrust to the boat 200. In this configuration, the conduit isolation valve 310 is in an open position and the ballast tank isolation valve 308 is in a closed position. The conduit isolation valve 310 can include a flapper that is disposed along the keel of the boat when closed to selectively divide fluid communication between the keel opening 314 and the water. The flapper can open, sweeping into the conduit 302 to selectively establish fluidic communication between the keel opening 314 and the water. With the conduit isolation valve 310 in an open position, the thruster 304 can act similar to a thruster and draws water into the conduit 302 via the keel opening 314 and expels it via the stern opening 316. The water thus expelled generates a propulsive thrust on the boat 200 that tends to move the boat in a forward direction at maneuvering speeds. In this embodiment, the keel opening 314 opens to a ramped portion that enables the thruster 304 to take on water more easily when the boat 200 is moving in a forward direction, as the forward motion of the boat tends to push water into the opening 314. When the boat is moving in a reverse direction, such as when the thruster 304 pushes water out of the opening 314, the ramped portion orients the water flow to cause a longitudinal force on the boat that pushes the boat in a rearward direction.

In a second configuration, with the valves as configured in the first configuration, the thruster 304 can be reversed, causing water to be taken in through the stern opening 316 and expelled through the keel opening 314. Water thus expelled causes a thrust on the boat that has a downward velocity component, but also a horizontal component that can tend to move the boat 200 backward. In another embodiment, a deflector that reverses water flow, such as a bucket, could be selectively placed over the outlet 316 re-directing water flow that would otherwise tend to move the boat 100 forward, to move the boat in reverse.

In a third configuration, the integrated thruster and ballast system 300 can be configured to fill the ballast tank 306. In this configuration, the conduit isolation valve 310 is closed and the ballast tank isolation valve 308 is open. The thruster 304 is configured to draw water into the stern opening 316, through the conduit 302 and into the ballast tank 306.

In a fourth configuration, the integrated thruster and ballast system 500 can be configured to empty the ballast tank 306. The valves 308 and 310 are in the same configuration as in the third configuration. The thruster 304 is reversed however, to draw water out of the ballast tank 306 and expel it out the stern opening 316. Water thus expelled may provide a propulsive thrust to the boat 200.

In other embodiments, a boat 100 can have more than one integrated thruster and ballast system 500 situated athwartships or longitudinally to provide maneuvering or propulsion. For example, two or more integrated thruster and ballast systems 500 could be spaced transversely across the boat with outlets 316 spaced along the transom or longitudinally down the hull. In various embodiments, the systems 500 could share some components or could be independent systems. For example, the systems 500 can be in fluid communication with the same ballast tank 306, or they could be connected to separate ballast tanks 306. In another example, the systems 500 could share a common inlet 314. In another example the systems 500 could share a common thruster 304 and distribution of water to the transom could be by way of appropriate conduits and valves. For example, the thruster 304 could feed water to a tee or other junction in a conduit, aft of the thruster, and flow of water through the separate legs of the junction could be controlled by valves located in each leg.

In yet other configurations, both valves 308 and 310 can be open such that the integrated thruster and ballast system 300 can simultaneously fill or drain the ballast tank 306 and provide propulsive thrust to the boat 200 in either fore or aft directions, corresponding to the direction of flow through the thruster.

Any of the integrated thruster and ballast systems disclosed can be used during a damage control situation. In the event that any of the compartments that they service become damaged and breached and begin to flood, the thrusters can be used to dewater the compartments and help prevent the boat from flooding, listing, or potentially sinking.

What is claimed is:

1. An integrated thruster and ballast system for a boat, the integrated thruster and ballast system comprising:

a conduit disposed within a hull of the boat, the conduit including:

a first opening in fluid communication with a body of water, a second opening in selective fluid communication with the body of water, and an outlet disposed within the boat;

a ballast tank in selective fluid communication with the conduit via the outlet;

a thruster disposed within the conduit and configured to move water through the conduit, and wherein the thruster is further configured to selectively fill and empty the ballast tank with ballast water;

a first valve disposed in the conduit and configured to selectively divide or establish the fluid communication between the conduit and the ballast tank; and a second valve disposed in the conduit and configured to selectively divide or establish the fluid communication between the second opening and the body of water.

2. The integrated thruster and ballast system of claim 1, wherein:

when the first valve is in an open position, the fluid communication between the conduit and the ballast tank is established; and when the second valve is in a closed position, the fluid communication between the body of water and the second opening is divided.

3. The integrated thruster and ballast system of claim 1, wherein:

when the first valve is in a closed position, the fluid communication between the conduit and the ballast tank is divided; and when the second valve is in an open position, the fluid communication between the body of water and the second opening is established.

4. The integrated thruster and ballast system of claim 3, wherein the thruster is configured to provide a thrust to the boat athwartships.

5. The integrated thruster and ballast system of claim 4, wherein the thrust pushes the boat in a port or starboard direction.

6. The integrated thruster and ballast system of claim 3, wherein the thruster is configured to provide propulsive thrust to the boat.

7. The integrated thruster and ballast system of claim 6, wherein the thrust pushes the boat one of forward or reverse.

8. The integrated thruster and ballast system of claim 1, further comprising:

a second conduit disposed within the hull of the boat, the second conduit including:

a third opening in fluid communication with the body of water, a fourth opening in selective fluid communication with the body of water, and a second outlet disposed within the boat;

a second ballast tank in selective fluid communication with the second conduit via the second outlet;

a second thruster disposed within the second conduit and configured to move water through the second conduit;

a third valve disposed in the second conduit and configured to selectively divide or establish the fluid communication between the second conduit and the second ballast tank; and a fourth valve disposed in the second conduit and configured to selectively divide or establish the fluid communication between the fourth opening and the body of water.

9. The integrated thruster and ballast system of claim 8, wherein one of the second opening or the fourth opening is disposed on a starboard side of the boat, and the other of the second opening or the fourth opening is disposed on the port side of the boat.

10. The integrated thruster and ballast system of claim 1, wherein as one of the first valve or second valve transitions between an open and closed position, a flow of the thruster is reduced.

11. The integrated thruster and ballast system of claim 8, wherein the thruster and the second thruster generate thrusts in a starboard direction in one configuration, and generate thrusts in a port direction in another configuration.

12. The integrated thruster and ballast system of claim 8, wherein one of the thruster or the second thruster generates a thrust in a starboard direction and the other of the thruster or the second thruster generates a thrust in a port direction to generate a couple on the boat causing a rotation about a vertical axis of the boat.

13. The integrated thruster and ballast system of claim 1, wherein the thruster is configured to dewater a compartment in the boat in a damage control situation.

14. The integrated thruster and ballast system of claim 1, wherein the thruster generates a moment which rotates the boat about a vertical axis.

15. A boat comprising the integrated thruster and ballast system of claim 1, wherein the integrated thruster and ballast system is configured as a bow thruster to provide thrust athwartships to the boat.

16. An integrated thruster and ballast system for a boat, the integrated thruster and ballast system comprising:

a conduit disposed within a hull of the boat, the conduit including:

a first opening in fluid communication with a body of water, an outlet disposed within the boat;

a ballast tank in selective fluid communication with the conduit via the outlet;

a thruster disposed within the conduit and configured to move water through the conduit to provide thrust in a first mode and to selectively fill and empty the ballast tank in a second mode;

a first valve disposed in the conduit and configured to selectively divide or establish the fluid communication between the conduit and the ballast tank in the second mode.

17. The system of claim 16, wherein the first opening is situated at the transom of the boat.

18. The system of claim 16, further comprising:

a second opening in selective fluid communication with the body of water;

a second valve disposed configured to selectively divide or establish the fluid communication between the second opening and the body of water.

19. The system of claim 18, wherein the second opening is located in a keel of the boat.

20. The system of claim 19, wherein the second valve includes a flapper operable to selectively open or close the second opening.

21. The system of claim 19, wherein the second opening expels water such that the expelled water causes a thrust on the boat that has a horizontal component tending to move the boat backward.

22. The system of claim 16, further comprising a deflector that is selectively positionable over the first opening and operable to deflect water expelled from the opening to cause a thrust on the boat tending to move the boat backward.

23. A boat including the integrated thruster and ballast systems of claim 17, wherein the ballast tank is selectively fluidly connected to the body of water using a plurality of first openings spaced apart from one another along the transom of the boat.

* * * * *